US005366797A

United States Patent [19]

Rötgers et al.

[11] Patent Number: 5,366,797

[45] Date of Patent: Nov. 22, 1994

[54] BONDED YARN BUNDLE, AND TEXTILE SHEET MATERIALS OBTAINABLE THEREFROM

[75] Inventors: André Rötgers, Bobingen; Wolfgang Gessner, Kelkheim, both of Germany

[73] Assignee: Hoechst Aktiengesellschaft, Germany

[21] Appl. No.: 3,798

[22] Filed: Jan. 13, 1993

[30] Foreign Application Priority Data

Jan. 15, 1992 [DE] Germany ..... 4200834

[51] Int. Cl.[5] ..... D03D 3/00

[52] U.S. Cl. ..... 428/229; 428/288; 428/365; 428/374; 428/395; 428/397; 139/420 A; 139/383 A; 162/903; 57/244; 57/905

[58] Field of Search ..... 428/374, 229, 288, 365, 428/395, 397; 57/243, 292, 296, 297, 905, 244; 139/420 A, 383 A; 162/903

[56] References Cited

U.S. PATENT DOCUMENTS

| | | | |
|---|---|---|---|
| 3,494,819 | 2/1970 | McAlister, Jr. | 161/89 |
| 4,275,117 | 6/1981 | Crandall | 428/373 |
| 4,290,209 | 9/1981 | Buchanan | 34/123 |
| 4,925,729 | 5/1990 | O'Conner | 428/245 |

FOREIGN PATENT DOCUMENTS

| | | | |
|---|---|---|---|
| 0052268 | 5/1982 | European Pat. Off. . | |
| 0156503 | 10/1985 | European Pat. Off. . | |
| 0307993 | 3/1989 | European Pat. Off. | C08J 5/10 |
| 1510817 | 2/1962 | Germany . | |
| 1958017 | 11/1966 | Germany . | |
| 1959574 | 6/1971 | Germany . | |
| 2818386 | 4/1978 | Germany . | |
| 3012288 | 10/1981 | Germany . | |
| 60-205044 | 10/1985 | Japan . | |

*Primary Examiner*—George F. Lesmes
*Assistant Examiner*—Chris Raimund
*Attorney, Agent, or Firm*—Connolly & Hutz

[57] ABSTRACT

Bonded yarn bundle, manufacture thereof and textile sheet materials obtainable therefrom.

There is described a yarn bundle having a tenacity of at least 42 cN/tex, comprising at least one twisted multifilament yarn composed of a first synthetic polymer, for example polyethylene terephthalate, whose individual filaments have become bonded together over essentially the entire thread cross-section by the melting of a second thermoplastic synthetic polymer whose melting point is at least 10° C. below the melting or decomposition point of the first synthetic polymer.

The yarn bundles are notable for high strength, good flexural stiffness and good hydrolysis resistance and are usable in particular for manufacturing textile sheet materials for use in hot, moist environments, in particular for use as wire cloths for papermaking machines.

13 Claims, No Drawings

BONDED YARN BUNDLE, AND TEXTILE SHEET MATERIALS OBTAINABLE THEREFROM

DESCRIPTION

The present invention relates to novel bonded threads made of a high-strength material that are suitable for manufacturing textile sheet materials which are to be used in hot, moist environments, i.e. under hydrolyzing conditions, for example industrial filter fabrics, in particular wire cloth for papermaking machines.

Filter fabrics that are usable in hot, moist conditions are widely manufactured from polymers, for example polyethylene terephthalate, which under the use conditions suffer appreciable degradation due to hydrolysis. For these uses, therefore, it has become indispensable to confer an additional finish on the fabric and/or the yarns which make up the fabric in order to inhibit hydrolytic degradation and thus prolong the useful life of these fabrics.

For instance, DE-U-1,958,017 describes a wire cloth woven from a polyester yarn finished with an acrylic resin before being woven. The curable acrylic resin ideally forms an unbroken sheath around the yarn and when cured forms a dense coat that is claimed to inhibit the hydrolytic degradation of the yarn. Owing to the method of manufacture of the yarn, the acrylic resin penetrates only part of the yarn, so that the bulk of the acrylic is present on the yarn surface as a coating.

Further multifilament yarns which can be used for manufacturing such wire cloths and which have been modified by impregnating with selected curable epoxy resin mixtures are described in DE-C-2,818,386 and DE-C-3,012,288.

It has also already been proposed to render multifilament yarns suitable for use in hot, moist environments by providing them with a coating of thermoplastic material. For instance, DE-A-1,959,574 describes a thread comprising a core yarn with a coating of a thermoplastic that is resistant to mechanical stress. According to the description, the thread is notable for high strength and good wear resistance. Furthermore, DE-B-1,510,817 discloses staple fiber yarns which have been wrapped and impregnated with a thermoplastic polymer. The twist level of the spun yarn on which these bonded yarns are based is only such that in the event of a subsequent plastic deformation of the bonded yarn the individual fibers can slip past one another. The yarns described are notable for good plastic deformability and have a strength level between that of the polymer portion and that of the staple fiber portion.

It has also already been suggested to manufacture sewing threads by twisting together multifilament yarns and thermoplastically meltable filaments. For instance, EP-B-52,268 describes a yarn bundle composed of at least three multifilament strands bound together by a formless mass of plastic. The essential feature of this yarn bundle is said to be that the plastics mass is essentially located on the inside of the yarn bundle and has been formed from a molten polymer filament, that the yarn bundle has been twisted as a whole, and that, in the cross-section of the bundle, the circumference is solely determined by filaments without any binding plastics mass whatsoever. EP-A-156,503 discloses a sewing thread comprising a multiplicity of twisted-together yarns, at least some of these yarns comprising a thermoplastic material which is situated on the surface of the sewing thread on the lines of the pattern produced by the twisting together and which is in a non-tackystate prior to sewing. After sewing, the thermoplastic material is transformed into a tacky state by heating and then binds the sewing thread to the material sewn together.

Finally, JP-A-60-205,044 discloses a V-belt manufactured from a cord which in addition to a main fiber component A contains up to 5% by weight, based on the total weight, of a meltable fiber component B that is melted by heating. The V-belt is notable for a high abrasion resistance.

It is an object of the present invention to provide a high-strength multifilament yarn which shall have a high flexural strength, a simple manner of manufacture and particular usefulness for manufacturing textile sheet materials which are to be used in a hot, moist environment.

This object is achieved by a yarn bundle having a tenacity of at least 38 cN/tex, preferably at least 42 cN/tex, comprising at least one twisted multifilament yarn composed of a first synthetic polymer whose individual filaments have become bonded together over essentially the entire thread cross-section by the melting of the second thermoplastic synthetic polymer whose melting point is at least 10° C., preferably from 15° to 50° C., below the melting or decomposition point of the first synthetic polymer.

The first synthetic polymer can be any desired meltable or nonmeltable polymer as long as it affords high-strength multifilament yarns having a tenacity of at least 45 cN/tex, preferably more than 60 cN/tex. Examples of such polymers are aramids, such as poly-p-phenyleneterephthalamide, poly-m-phenyleneisophthalamide or copolymers based on terephthalic acid and p-phenylenediamine and 3,4'-diaminodiphenyl ether, or based on terephthalic acid and p-phenylenediamine, 4,4'-diaminobenzanilide and 5,5'-dimethylbenzidine, polyacrylonitrile, polyphenylene sulfide, aromatic polyesters, such as poly-p-hydroxybenzoate, polyamides, such as nylon-6 or nylon-6,6, polyether ketones or in particular aliphatic polyesters, such as polyethylene terephthalate or copolyethylene terephthalate containing for example aliphatic or aromatic dicarboxylic acid cocomponents, such as isophthalic acid or adipic or sebacic acid, or aliphatic or aromatic diol cocomponents, such as butylene glycol, cyclohexanedimethanol, cyclohexanediol or resorcinol.

The yarn composed of the second synthetic polymer need not necessarily be a multifilament yarn, but can also be a yarn spun from staple fibers or be a stretch-broken tow. Preferably, however, it is likewise a multifilament yarn.

The second polymer must be a meltable material whose melting point is sufficiently below the melting or decomposition point of the first polymer that the multifilament yarn of the first polymer suffers virtually no strength loss under the processing conditions. This will be the case in general when the melting point of the second polymer is at least 10° C. below the melting or decomposition point of the first polymer. This is the criterion under which the second polymer is selected given the first polymer. Examples of possible thermoplastic polymers suitable for use as second component yarn are thermoplastic aramids as described in EP-A-307,993 or in particular aliphatic polyesters, such as polyethylene terephthalate or polybutylene terephthalate.

If the first component yarn is made of polyethylene terephthalate or of a copolyethylene terephthalate, then the second component yarn is preferably made of polybutylene terephthalate.

The melting of the second component yarn must be carried out in such a way that this component yarn becomes distributed over essentially the entire thread cross-section and bonds the individual filaments of the first component yarn together uniformly by melting. To this end the thread is heated under tension, as will be described hereinafter.

The linear density of the multifilament yarns of the first polymer component making up the yarn bundle of the invention is customarily from 550 to 2200 dtex, preferably from 1050 to 1150 dtex.

The linear density of the yarns of the second polymer component making up the yarn bundle of the invention is customarily from 250 to 1100 dtex, preferably from 500 to 600 dtex.

The total linear density of the yarn bundle of the invention is customarily from 800 to 6000 dtex, preferably from 1000 to 3500 dtex.

The yarn bundle of the invention is notable for a high ultimate tensile strength; it amounts to approximately the ultimate tensile strength of the multifilament yarns of the first polymer component making up the yarn bundle of the invention.

The yarn bundle of the invention is further notable for a high flexural stiffness. In fact its flexural stiffness corresponds largely to that of a monofilament of the same diameter.

The proportion of the second polymer is customarily less than 60% by weight, preferably from 20 to 50% by weight, based on the total weight of the yarn bundle.

The yarn bundle of the invention has particularly preferably a rectangular cross-section with, in particular, rounded corners. Threads having such cross-sections are particularly useful for manufacturing filter fabrics for papermaking machines. Threads having these cross-sectional shapes are described in U.S. Pat. No. 4,290,209.

The yarn bundle of the invention can be composed of one or more high-strength multifilament yarns. These multifilament yarns can be made of the same or different types of polymer. This is also true of yarns made of the second polymer.

The yarn bundle of the invention preferably comprises two mutually twisted-together multifilament yarns. The polymers used are preferably of the same type, e.g. polyester/polyester.

The yarn bundle of the invention can be manufactured by a process comprising the following steps:

i) twisting together at least one multifilament yarn composed of a first synthetic polymer having a tenacity of at least 45 cN/tex with at least one yarn composed of a second thermoplastic synthetic polymer whose melting point is at least 10° C. below the melting or decomposition point of the first synthetic polymer, ii) heating the thread under tension to a temperature which is below the melting point of the first and above the melting point of the second synthetic polymer, so that the yarn composed of the second thermoplastic synthetic polymer melts virtually completely and the individual filaments of the multifilament yarn composed of the first synthetic polymer become bonded together by the molten material over essentially the entire thread cross-section.

The twisting together of the component yarns can be effected on any apparatus suitable for this purpose, for example on uptwisters, ring twisters or two-for-one twisters.

The heating in step ii) is to a temperature sufficient to melt the yarn composed of the second thermoplastic synthetic polymer virtually completely, so that it loses its yarn structure and becomes distributed over virtually the entire thread cross-section. In general, this temperature must be at least the melting temperature of the second polymer; however, depending on the tension applied, it is also possible to choose a somewhat lower temperature.

The tension to be used in step ii) is chosen in such a way as to achieve the extensibility desired for the end use. In general, yarn tensions of from 0.15 to 0.25 cN/dtex are sufficient for this step.

The above-defined process likewise forms part of the subject-matter of the present invention.

The yarn bundle of the invention can be used to manufacture textile sheet materials that are particularly suitable for use in a hot, moist environment. The invention therefore also provides these sheet materials and a use thereof.

These textile sheet materials can be produced by any sheet-forming technology known per se wherein yarn bundles having a relatively high flexural stiffness can be processed. Examples are laid, knitted and in particular woven fabrics. The woven fabrics are in particular plain-woven.

The textile sheet materials of the invention can be used in particular as filter material in hot, moist environments, as for the filtration of hot liquids or of hot, moisture-containing gases, in particular as wire cloths for papermaking machines.

The examples which follow illustrate the invention without limiting it.

A high-strength multifilament yarn composed of polyethylene terephthalate (PET) of the designation dtex 1100 f 200 TO and a multifilament yarn composed of polybutylene terephthalate (PBT) of the designation dtex 550 f 96 TO are folded on a ring twister to form a thread of the designation ×1Z 340×2 S 340.

This thread is then set on a drawing machine at 235° C. under a tension of 750 cN in the course of a residence time of 60 seconds.

Under these conditions the PBT yarn melts completely and, as it cools down, sets to form a stiffening skeleton. The thread obtained is impossible to open. Its ultimate tensile strength is 142 N (which corresponds to a tenacity of 43 cN/tex); its breaking extension is 10%.

Subsequently a 40-hour hydrolysis test is carried out at 135° C. in an autoclave. Afterwards the tenacity of the thread is still 47% of the original value.

What is claimed is:

1. A hydrolysis resistant filter fabric prepared by drawing under heat and tension a yarn bundle comprising two mutually twisted together multifilament yarns wherein at least one of said yarns is composed of a first synthetic polyester polymer and the other of said yarns is composed of a second thermoplastic synthetic polyester polymer whose melting point is at least 10° C. below the melting or decomposition point of the first synthetic polymer, and wherein the first synthetic polymer is polyethylene terephthalate or a copolyester comprising polyethylene terephthalate units and the second synthetic polymer is polybutylene terephthalate or a copolyester comprising polybutylene terephthalate units, the drawn yarn bundle having a tenacity of at least 38 cN/tex.

2. The fabric of claim 1 wherein the proportion of the second polymer is from 20 to 50% by weight, based on the total weight of the yarn bundle.

3. The fabric of claim 1 wherein said yarn bundle has a rectangular cross-section with rounded corners.

4. The fabric of claim 1 wherein each of said multifilament yarns has a linear density of from 500 to 1150 dtex, and the total linear density of the yarn bundle is from 1000 to 3500 dtex.

5. The fabric of claim 1 in the form of a textile sheet.

6. The fabric of claim 1 in the form of a plain woven fabric.

7. A wire cloth for papermaking machines comprising the fabric of claim 1.

8. A textile sheet material comprising yarn bundles each having a tenacity of at least 38 cN/tex, each yarn bundle having at least one twisted multifilament yarn composed of a first synthetic polymer whose individual filaments have become bonded together over essentially the entire thread cross-section by the melting of a second thermoplastic synthetic polymer whose melting point is at least 10° C., below the melting or decomposition point of the first synthetic polymer, and wherein each yarn bundle has a rectangular cross-section.

9. A textile sheet material as in claim 8 wherein the rectangular cross-section of each yarn bundle has rounded corners.

10. A textile sheet material as in claim 8 wherein the first synthetic polymer is polyethylene terephthalate or a copolyester comprising polyethylene terephthalate units.

11. A textile sheet material as in claim 8 wherein the proportion of the second polymer is from 20 to 50% by weight, based on the total weight of each yarn bundle.

12. A textile sheet material as in claim 8 comprising a woven fabric.

13. A wire cloth for papermaking machines comprising the textile sheet material of claim 8.

* * * * *